US009949521B2

(12) United States Patent
Isobe

(10) Patent No.: US 9,949,521 B2
(45) Date of Patent: Apr. 24, 2018

(54) SHIELD

(71) Applicant: SHOEI CO., LTD., Tokyo (JP)

(72) Inventor: Eiji Isobe, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 18 days.

(21) Appl. No.: 14/729,018

(22) Filed: Jun. 2, 2015

(65) Prior Publication Data

US 2015/0351480 A1 Dec. 10, 2015

(30) Foreign Application Priority Data

Jun. 6, 2014 (JP) ..... 2014-117265

(51) Int. Cl.
*A42B 3/04* (2006.01)
*A42B 3/22* (2006.01)

(52) U.S. Cl.
CPC ..... *A42B 3/0493* (2013.01); *A42B 3/22* (2013.01)

(58) Field of Classification Search
USPC ..... 2/9, 10, 6.3–6.7
See application file for complete search history.

(56) References Cited

U.S. PATENT DOCUMENTS

| | | | | |
|---|---|---|---|---|
| 4,097,930 A | 7/1978 | Bay | | |
| 4,564,959 A | 1/1986 | Zahn | | |
| 7,003,802 B2 * | 2/2006 | Broersma | A42B 3/225 | 2/424 |
| 7,264,368 B2 * | 9/2007 | Sherring | A42B 3/04 | 2/906 |
| 2008/0172778 A1 * | 7/2008 | Lysogorski | A42B 3/185 | 2/436 |
| 2011/0072563 A1 * | 3/2011 | Choi | A42B 3/221 | 2/422 |
| 2012/0047615 A1 * | 3/2012 | Shiue | A63B 33/002 | 2/9 |

FOREIGN PATENT DOCUMENTS

| | | |
|---|---|---|
| DE | 102005006087 B4 | 3/2007 |
| DE | 20 2015 001496 | 3/2015 |
| JP | S60-009906 | 1/1985 |
| JP | H08-158136 | 6/1996 |
| WO | 95/20885 | 8/1995 |

OTHER PUBLICATIONS

"The Extended European Search Report of European Counterpart Application", dated Jan. 26, 2016, pp. 1-7.
"Office Action of Europe Counterpart Application," dated Apr. 10, 2017, p. 1-p. 4.

* cited by examiner

*Primary Examiner* — Katherine Moran
(74) *Attorney, Agent, or Firm* — JCIPRNET

(57) ABSTRACT

A shield includes one or more protrusion members having shapes protruding from an outer surface of the shield are provided or, alternatively, one or more recesses having shapes depressed from the outer surface of the shield are carved. The one or more protrusion members or the one or more recesses are located at vicinities of both side positions on the shield for covering a face where the lateral width of the shield in right and left directions becomes a maximum.

4 Claims, 8 Drawing Sheets

FIG. 7

| Rider posture FIG.6 | Shield | Rider head angle | Drag force (%) | Lift force (%) | Yaw force (%) |
|---|---|---|---|---|---|
| a | Conventional Product | 20 | 100 | 100 | 100 |
| | Present invention | | 91 | 96 | 90 |
| b | Conventional Product | 30 | 102 | 68 | 103 |
| | Present invention | | 96 | 66 | 71 |
| c | Conventional Product | 35 | 75 | 69 | 42 |
| | Present invention | | 75 | 69 | 39 |

Note) Measured values of individual forces normalized such that each measured value at rider posture (a) becomes 100%

SHIELD

CROSS-REFERENCE TO RELATED APPLICATIONS

This application claims the priority benefit of Japan application serial no. 2014-117265, filed on Jun. 6, 2014. The entirety of the above-mentioned patent application is hereby incorporated by reference herein and made a part of this specification.

BACKGROUND OF THE INVENTION

Field of the Invention

The present invention relates to a shield and a helmet.

Related Art

The present invention relates to a shield for a helmet worn by a motorcycle rider and a helmet installed this shield.

Each motorcycle rider is required by law to wear a helmet for protecting the head at the time of possible occurrence of an accident. Such a helmet has also a function of shielding, to a certain extent, various jarring noises such as an engine sound, an exhaust sound, and a wind noise generated when traveling of a motorcycle.

Among these kinds of noises, the engine sound and the exhaust sound contain relatively high frequency components and hence are considerably reduced when passing through the helmet. In contrast, the wind noise is a sound generated by friction between air and the motorcycle or the rider's body and contains relatively low frequency components. Thus, even after passing through the helmet, the wind noise is hardly reduced and serves as a large trouble for the rider. Here, it is known that the wind noise is generated in association with a situation that the layer of air flowing along the outer surface of the helmet departs from the helmet in a rear part so as to form the air current.

In recent years, the structures of a ventilator for air intake and air exhaust or a stabilizer for air rectification and the like attached to the outer surface of a full face type helmet are complicated or their sizes are increased. Such a ventilator and a stabilizer swirl a traveling wind and increase remarkably the intensity of the wind noise. Thus, the wearers of the full face type helmets hear such a loud wind noise.

On the other hand, along with such a noise, the aerodynamic characteristics of the helmet are an issue. That is, the following three forces are generated and act on a helmet during a running: a lift force which is a force acting in a direction at right angles to the air flow such as to lift up the helmet; a drag force acting in parallel to the air flow such as to push the helmet in a direction opposite to a traveling; and a yaw force acting such as to pull the helmet sideways. Improvement of the aerodynamic characteristics such as the lift force, the drag force, and the yaw force is also required.

Patent Document 1 describes a configuration that depressions and protrusions are provided in the surface of a helmet in order to reduce the fluid resistance acting on the helmet wearer as a result of a remarkable air resistance at the high speed running. That is, like in a golf ball, depressions and protrusions (dimples) are provided in the entire surface of the helmet so that the air resistance is reduced.

Patent Document 2 describes a configuration that depressions and protrusions are provided in the outer surface of a helmet in order to reduce a noise generated close to the ears. In this configuration, the processing is performed on a half of the entire surface of the helmet so that an effect of reducing the air resistance is intended similarly to Patent Document 1.

Patent Document 3 describes a helmet in which dimple processing is performed on an upper part of a shield. Since, with increasing speed, the rider takes a more frontward-leaning posture and hence the site hit by a running wind becomes close to the position of the forehead of the helmet wearer, that is, an upper part of the shield and an upper part of the helmet (around the forehead of the wearer). Thus, a structure is arranged in the vicinity of the boundary between the shield and the helmet upper part so that the surrounding turbulence is divided into several pieces and thereby the air resistance is reduced.

PRIOR ART REFERENCES

Patent Documents

Patent Document 1: Japanese Patent Laid-Open Publication No. S60-009906.

Patent Document 2: Japanese Patent Laid-Open Publication No. H08-158136.

Patent Document 3: German Patented Invention No. 102005006087.

SUMMARY OF THE INVENTION

In recent years, helmets are designed in a shape causing a low aerodynamic drag. Thus, as long as any components do not protrude from the side surfaces of the helmet, the air flowing from frontward to rearward along the side surfaces of the helmet does not cause a remarkable drag. Nevertheless, even in such a helmet, in some cases, a wind can be swirled upward along the helmet from the helmet bottom part, that is, from the lower part of the helmet. This causes a problem that a noise is generated close to the ears or, alternatively, an air resistance is generated on the helmet in a severe case.

Further, in contrast to a golf ball, the helmet is not rotated and hence the site receiving a traveling wind is the front surface, that is, a frontward part relative to the center in viewing the helmet from the side. This indicates that instead of the entirety of the outer surface of the helmet as disclosed in Patent Document 1, it is sufficient that the dimple processing is performed only on the front part (or the shield alone, in an extreme case) of the helmet where a most satisfactory effect is obtained in reducing the fluid resistance acting on the helmet wearer.

Further, in the helmet disclosed in Patent Document 2, the depressions and protrusions formed in the outer surface of the front part are not uniform over the entire surface of the helmet. This causes a possibility that when the helmet wearer turns the head somewhat aside, the air resistance increases. Further, in a certain aspect, this mechanism is exaggerated as a mechanism for reducing a noise generated close to the ears of the helmet wearer.

Further, in the helmet described in Patent Document 3, dimple processing is performed on an upper part of the shield. However, when this site is designed in a stream line shape from the beginning, such a structure (or such dimple processing) becomes unnecessary. For example, such a structure is effective when being provided in a portion designed such as to increase the air resistance like in a configuration that such a structure is provided on a spoiler edge serving as a wing portion in a rear part of a racing car.

Thus, one or more embodiments of the present invention have been devised in view of the problems in the above-mentioned previous art. A shield and a helmet are provided. The shield and the helmet can reduce a noise generated close to the ears and an air resistance acting on the helmet which are generated by a wind swirled upward along the helmet from the helmet bottom part, that is, from the lower part of the helmet.

In one or more embodiments of the present invention, depressions and protrusions are provided for generating small turbulences on the side surfaces of the helmet so as to disturb the air flow therein, and thereby the position where the air flow separates from the helmet is moved rearward, because the air resistance is expected to be generated at the position where the air flow on the helmet side surfaces separates from the helmet outer surface. Further, the noise is reduced as the position where the air flow separates from the helmet becomes distant from the ears of the wearer.

These depressions and protrusions need be located frontward relative to a position where the air flow along the helmet side surfaces becomes condensed, and further need have a sufficient size for disturbing the air flow. Further, from the perspective of noise reduction, the depressions and protrusions need be arranged in the vicinities of the ears of the wearer. Further, from the perspective of industrial simplicity, it is appropriate that these depressions and protrusions are formed by attaching protrusion members to the helmet outer surface or, alternatively, by forming recesses by carving the helmet outer surface. From the above-mentioned reasons, the protrusion members or the recesses are arranged in the vicinities of positions where the lateral width, from right side to left side, of the helmet becomes the maximum, so that the above-mentioned problems are intended to be resolved.

For the purpose of resolving the above-mentioned problems, in one or more embodiments of the present invention, at vicinities of both side positions on a shield for covering a face where the lateral width of the shield in right and left directions becomes a maximum, the protrusion members having shapes protruding from an outer surface of the shield are provided or, alternatively, the recesses having shapes depressed from the outer surface of the shield are carved.

For the purpose of resolving the above-mentioned problems, in one or more embodiments of the present invention, at vicinities of both side positions on a helmet where the lateral width of the helmet in right and left directions becomes a maximum, the protrusion members having shapes protruding from an outer surface of the helmet are provided or, alternatively, the recesses having shapes depressed from the outer surface of the helmet are carved.

According to one or more embodiments of the present invention, a shield and a helmet can reduce the noise and the air resistance by a virtue of depressions and protrusions formed by the protrusion members or the recesses in the outer surfaces of the helmet side surfaces.

BRIEF DESCRIPTION OF THE DRAWINGS

FIG. 7 is a table showing experimental results in which a relation between the rider head angle and forces acting on a helmet in a traveling wind in a situation that a shield to which the protrusion members according to an embodiment of one or more embodiments of the present invention were attached was compared with the previous one.

DESCRIPTION OF THE EMBODIMENTS

In one or more embodiments of the present invention, the above-mentioned problems in the aerodynamic characteristics and the wind noise in the helmet of the previous art are resolved. That is, the protrusion members are attached to the side portions of a shield mounted on a helmet or, alternatively, the recesses are formed by carving the helmet outer surface so that the resistance force on the helmet is reduced and the noise is suppressed. Here, an embodiment of one or more embodiments of the present invention is given below for a case that the protrusion members are attached. However, even if the recesses are provided, it is obvious that a substantially similar effect is obtained.

Figure 1:
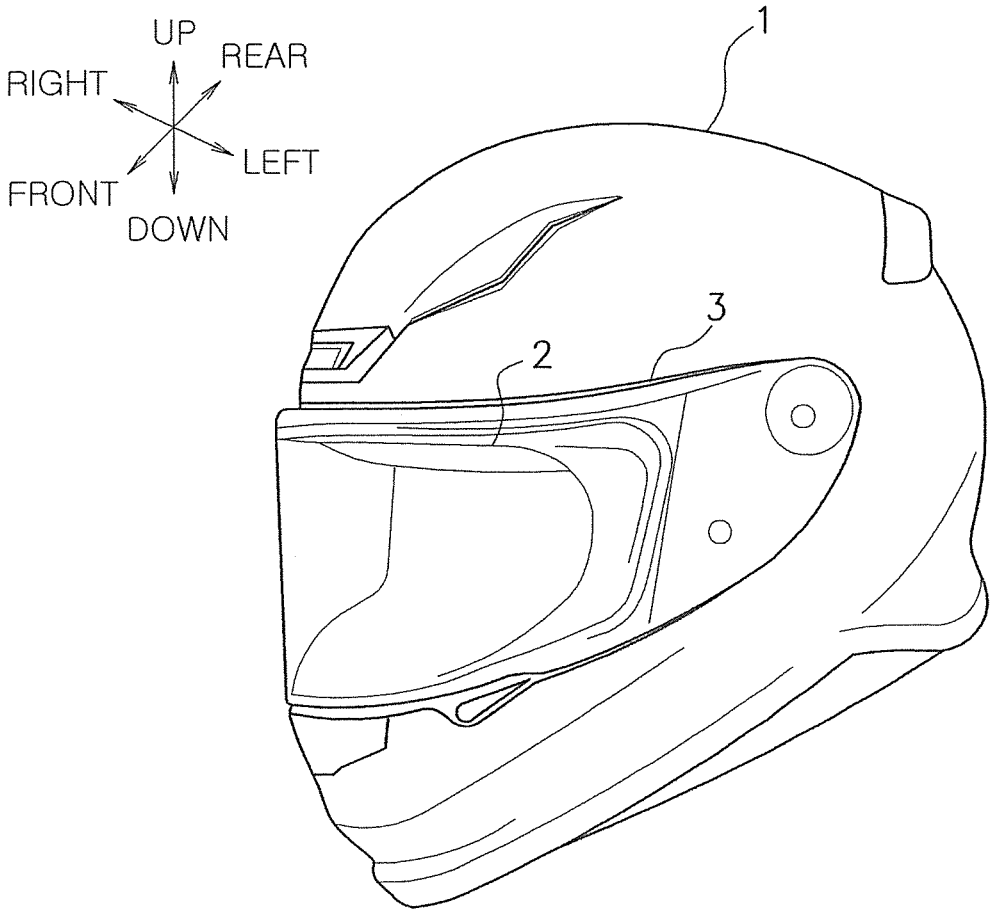
FIG. 1 is a perspective view of the entirety of a helmet installed a shield.
Figure 2:
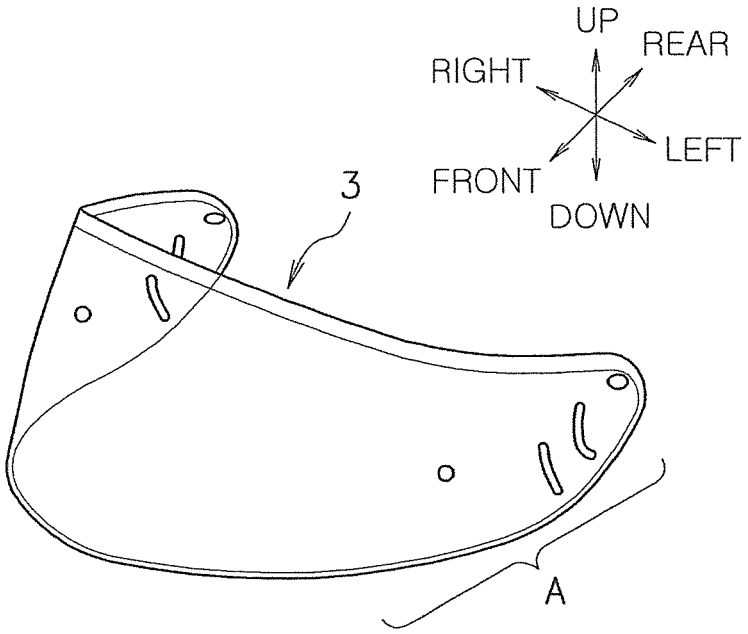
FIG. 2 is a perspective view of the entirety of a shield.

First, the overall shapes of a shield and a helmet according to the present embodiment are described below. FIG. 1 is a perspective view of the entirety of a helmet installed a shield. FIG. 2 is a perspective view of the entirety of the shield.

The helmet 1 (see FIG. 1) for a motorcycle rider is installed a shield 3 (see FIG. 2) for covering a front window 2 for providing a field of view to the rider in an attachable and detachable manner. The shield 3 is made from a hard synthetic resin (such as polycarbonate) having a light transmitting property. Then, two or more protrusion members according to the present embodiment are provided in a part A which is one of portions located at the right and left side surface ends of the shield 3 having a roughly elliptic shape in FIG. 2, within the surface facing against the direction of traveling. Obviously, also in a case that the recesses are provided, the recesses are provided at similar positions.

Next, the shield and the protrusion members according to the present embodiment are described below. FIG. 3 is an enlarged view of a main part showing a situation that the protrusion members are attached to the shield according to the present embodiment.

Figure 3A:
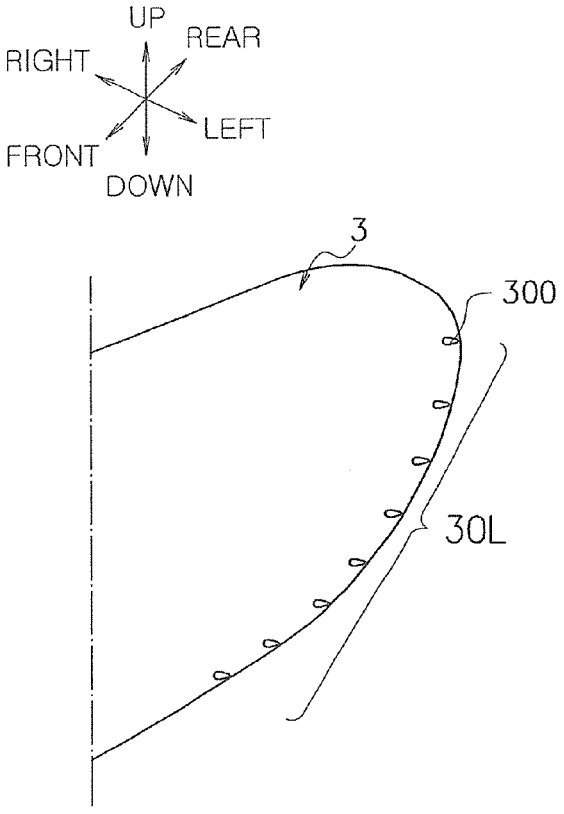
FIG. 3A is a view of a main part showing a situation that members are attached to a shield according to an embodiment of one or more embodiments of the present invention.
Figure 3B:
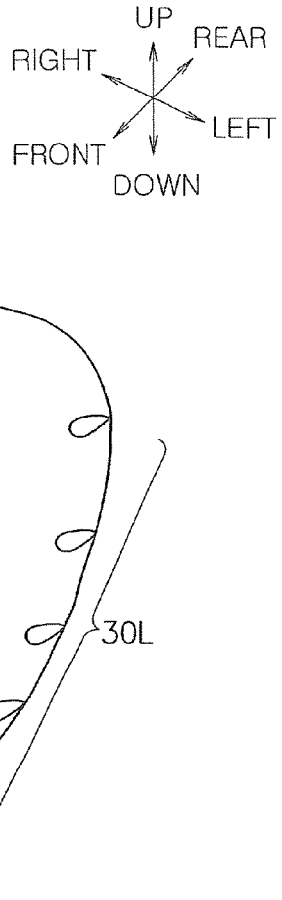
FIG. 3B is an enlarged view of a main part showing a situation that members are attached to a shield according to an embodiment of one or more embodiments of the present invention.

As shown in FIG. 3A, two or more protrusion members 300 are provided in a periphery part 30L at the left side surface end of the shield 3. Further, although not illustrated, two or more protrusion members are provided similarly in the periphery part at the right side surface end. Here, in FIG. 4, the motorcycle is mounted a cowl.

Next, the rider head position of a dummy head in a state of riding a motorcycle is described below. FIG. 6 is a diagram used for describing a situation that the rider head angle is changed in a situation that the shield to which the protrusion members according to the present embodiment are attached is mounted.

As shown in FIG. 6, the inclined angle of the dummy head 4 is denoted by the angle θ when the rider takes a frontward-leaning posture relative to the horizontal plane on his motorcycle. As described later, the rider takes a more frontward-leaning posture with increasing the speed of the motorcycle. Thus, the rider head angle θ increases with increasing the speed of the motorcycle.

Figure 4:
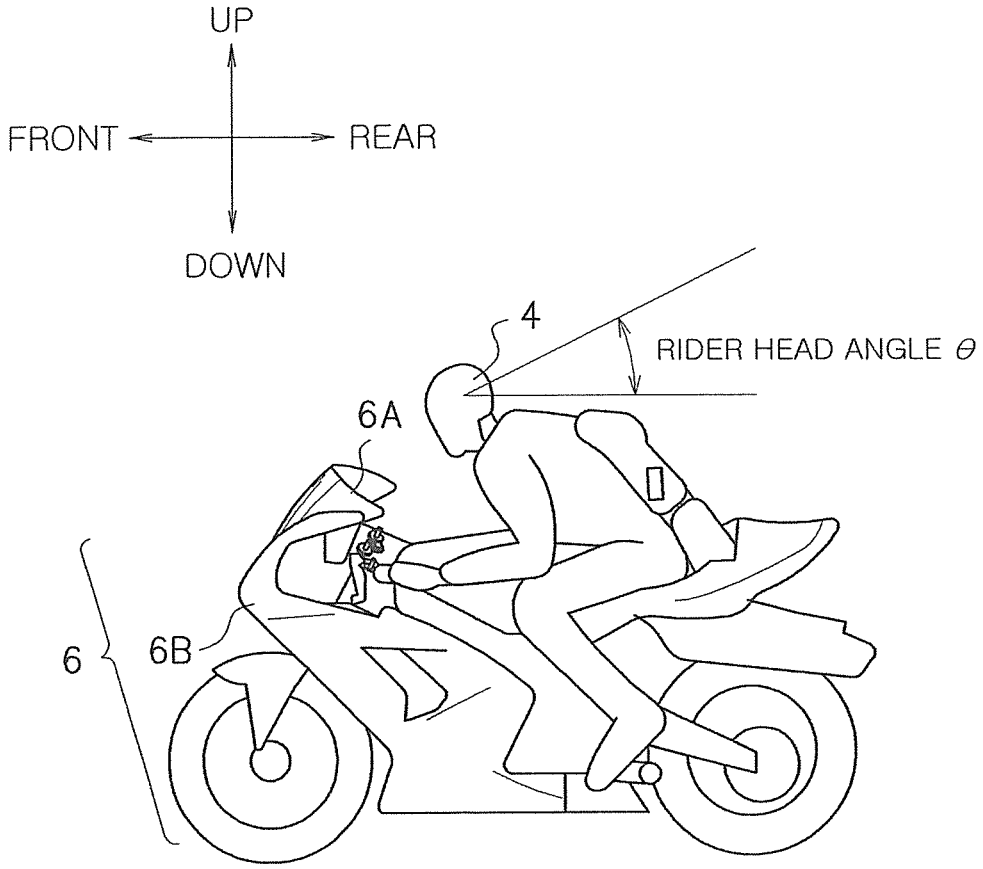
FIG. 4 is a diagram used for describing the rider head angle of a dummy head in a state of riding on a motorcycle.

Next, the cowling (the cowl) provided in the motorcycle is described below. FIG. 4 is a diagram showing a situation that the motorcycle is mounted the cowl.

As shown in FIG. 4, the cowling (the cowl) 6 indicates the entirety consisting of a windshield part 6A provided in a front upper part of the motorcycle and a body cover part 6B on the vehicle body front side of the motorcycle 5. When the cowling (the cowl) 6 is mounted, it can avoid a traveling wind directly hits the rider.

Figure 5:
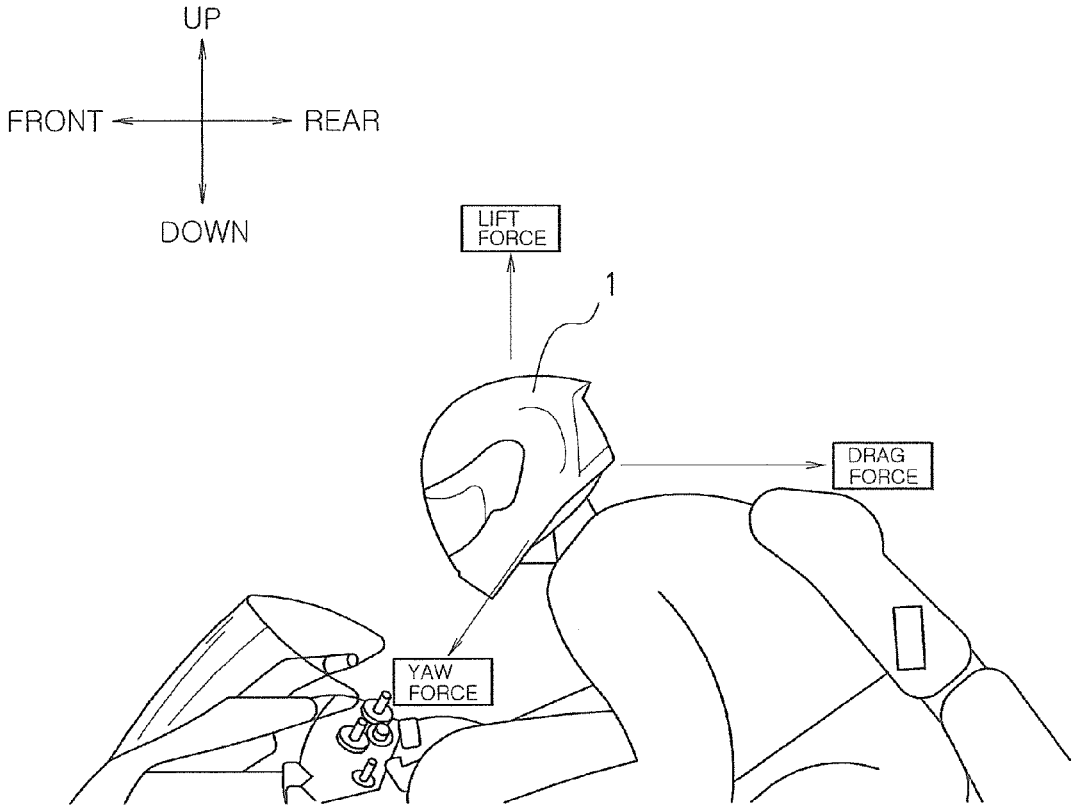
FIG. 5 is a diagram used for describing a relation between forces acting on a helmet in a situation that a running wind is received from frontward in a running state.

Next, a relation between forces acting on the helmet is described when a traveling wind is received from frontward during the running. FIG. 5 is a diagram used for describing a relation between the forces acting on the helmet when a traveling wind is received from frontward in a running state.

As shown in FIG. 5, three forces are generated by the wind pressure on the helmet 1 of the rider during the riding. A first is a drag force which is a force of pulling the helmet 1 immediately rearward. A second is a lift force which is a force of pulling the helmet 1 immediately upward. A third is a yaw force which is a force of pulling the helmet 1 immediately sideward. The helmeted dummy doll simulating the rider in traveling was experimented with changing the rider head angle θ. And the drag force, the lift force, and the yaw force acting on the dummy head were measured in order to review the differences between the helmet 1 mounted the shield 3 with the members according to the present embodiment and one mounted the conventional shield.

FIG. 7 is a table showing the experimental results in which the shield with the members according to the present embodiment was compared with the conventional shield about the forces acting on the helmet in traveling wind at each rider head angle. In those experiments, each eight protrusion members having a stream line shape were provided on the both side surface ends of the shield in a manner that each tip of the stream line was oriented rearward. Further, in the experiments, three rider head positions were set up at a wind speed of 160 km/h. Then, 3,000 measurement data logs per approximately 300 seconds were acquired and then the average was calculated as the measured value.

Figure 6A:
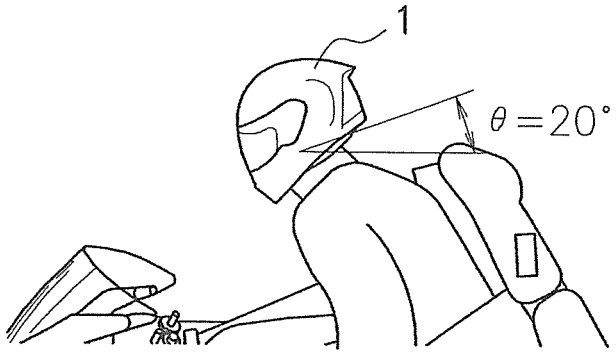
FIG. 6A is a diagram used for describing a situation that the rider head angle is 20 degrees in a situation that a shield to which protrusion members according to an embodiment of one or more embodiments of the present invention are attached is mounted.
Figure 6B:
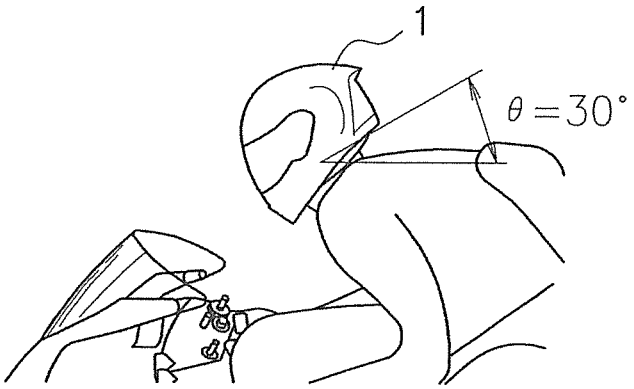
FIG. 6B is a diagram used for describing a situation that the rider head angle is 30 degrees in a situation that a shield to which protrusion members according to an embodiment of one or more embodiments of the present invention are attached is mounted.
Figure 6C:
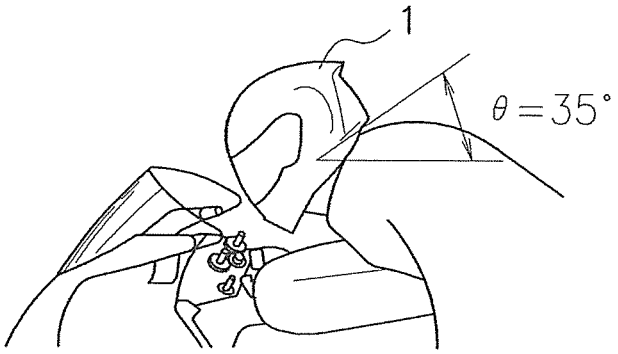
FIG. 6C is a diagram used for describing a situation that the rider head angle is 35 degrees in a situation that a shield to which protrusion members according to an embodiment of one or more embodiments of the present invention are attached is mounted.

As for the rider head angle θ, experiments were performed for three angle values consisting of θ=20 degrees shown in FIG. 6A, θ=30 degrees shown in FIG. 6B, and θ=35 degrees shown in FIG. 6C selected from actual riding postures. FIG. 6 is a diagram used for describing a situation that the rider head angle was changed with the shield which the protrusion members according to the present embodiment were provided. Here, the entire present experiments were performed in a situation that the cowling (the cowl) 6 was provided.

As seen from the results of the experiments shown in FIG. 7, at the rider head angle of 20 degrees, the drag force has decreased by 9%, the lift force has decreased by 4%, and the yaw force has decreased by 10%. Further, at the rider head angle of 30 degrees, the drag force has decreased by 6%, the lift force has decreased by 2%, and the yaw force has decreased by 32%.

Figure 8:
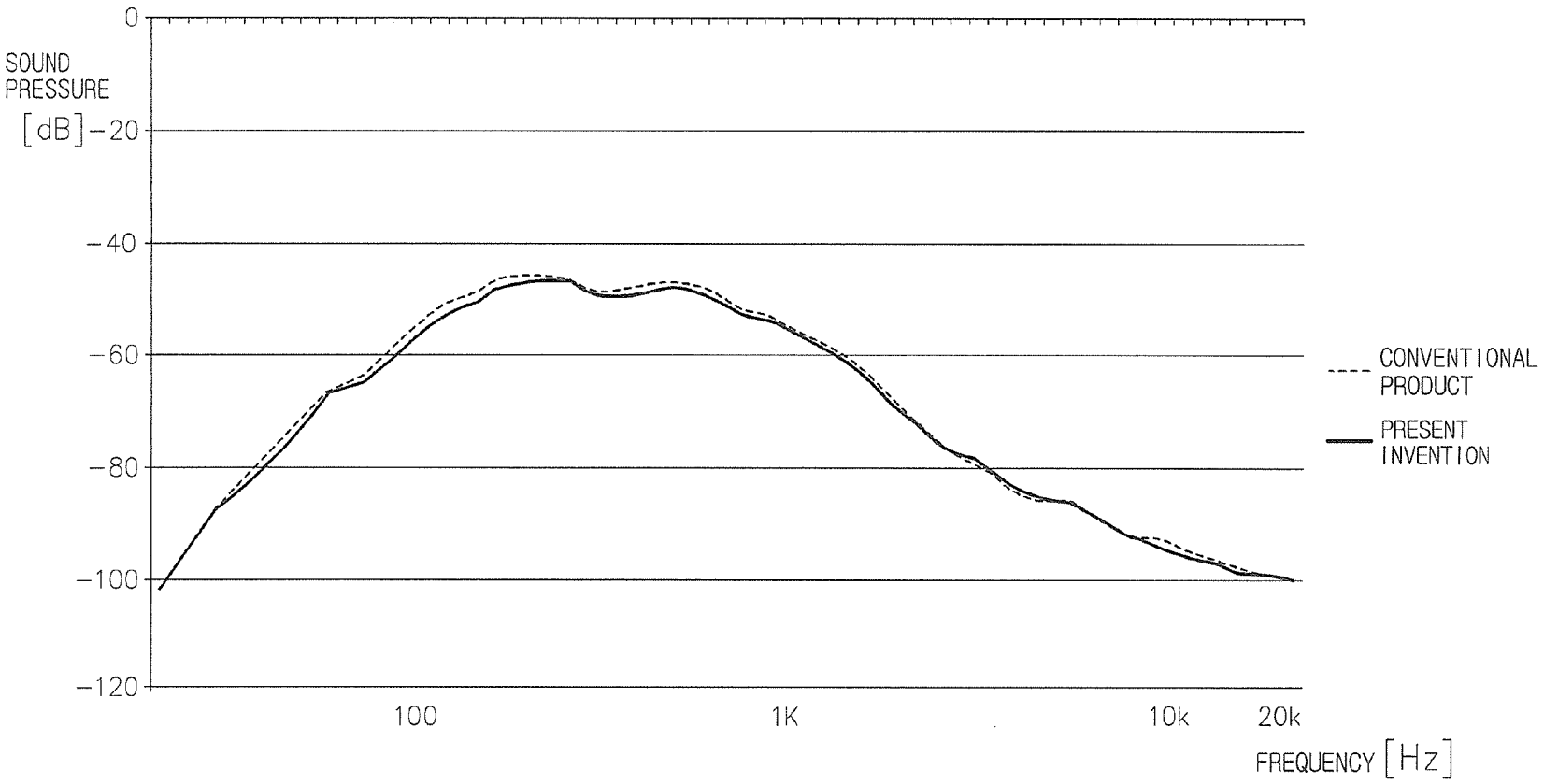
FIG. 8 is a graph showing experimental results of measurement of a noise reaching the ears of a wearer in a traveling wind in a situation that a shield to which the protrusion members according to an embodiment of one or more embodiments of the present invention was attached was compared with the previous one.

FIG. 8 is a graph showing the results of measurement of a noise reaching the ears of the helmet wearer when a traveling wind was received. The solid line indicates the results of the helmet provided with the shield which had the members according to the present embodiment. The dashed line indicates the results of the conventional one. The horizontal axis of the graph indicates the sound frequency and the vertical axis indicates the sound pressure level. As seen from the results of the experiments, at almost all frequencies, the helmet provided with the shield which had the members according to the present embodiment had a lower sound pressure level than the conventional one.

Here, the experiments shown in FIGS. 7 and 8 were performed in a situation that eight protrusion members attached to both the right and left side surface ends of the shield. However, an arbitrary number of protrusion members may be attached to the shield.

Further, also as for the orientation of each protrusion member, the orientation need not be substantially in parallel to the helmet bottom part. Further, the intervals between the protrusion members need not be regular. These conditions may be set up arbitrarily in accordance with an intention which air flow is to be separated from which position. That is, after observed the flow of air on the helmet side surfaces, the number, the positions, and the interval of the protrusion members may be designed such as to be most effective.

Further, the embodiment given above has been described for a shield of a motorcycle helmet serving as a typical article. However, one or more embodiments of the present invention can be applied also to an article other than a shield of a motorcycle helmet.

The present invention can give a shield and a helmet which can suppress the noise and the air resistance, because of reducing a noise generated close to the ears an air resistance acting on the helmet which are caused by the wind swirled along the helmet surface from lower side to upper side owing to a wind flowing at the helmet bottom part, that is, from the throat to the neck of the helmet wearer.

The present invention has been described above with reference to preferred embodiments of one or more embodiments of the present invention. Although the present invention has been described with reference to particular and specific examples, various modifications and changes may be made on these specific examples without departing from a wide variety of the spirit and the scope of the present invention set forth in the claims.

What is claimed is:

1. A shield, which can be rotatably connected to a helmet to cover a front window of the helmet for providing a field view to a helmet wearer, is made from a light transmitting synthetic resin and has an inner surface intended to face the helmet wearer and an outer surface, comprising:

one or more protrusion members directly formed on the outer surface of the shield and each having a protruding shape protruding from the outer surface of the shield that are provided or, alternatively, one or more recesses each having a depressed shape depressed from the outer surface of the shield that are carved, from vicinities of both side positions on the shield where the lateral width of the shield in right and left directions becomes a maximum to rear ends of the shield, wherein each of the one or more protrusion members or the one or more recesses has a stream line shape which is on the outer surface of the shield, wherein the stream line shape is a round end tapering to a narrower end.

2. The shield according to claim 1, wherein the one or more protrusion members or the one or more recesses are arranged along a circumference of the shield outer periphery.

3. The shield according to claim 1, wherein each of the one or more protrusion members or the one or more recesses has a horizontally elongated shape extending in frontward and rearward directions of the shield.

4. The shield according to claim 2, wherein each of the one or more protrusion members or the one or more recesses has a horizontally elongated shape extending in frontward and rearward directions of the shield.

* * * * *